United States Patent [19]

Brandt

[11] Patent Number: 4,663,890

[45] Date of Patent: May 12, 1987

[54] METHOD FOR MACHINING WORKPIECES OF BRITTLE HARD MATERIAL INTO WAFERS

[75] Inventor: Georg Brandt, Erlangen, Fed. Rep. of Germany

[73] Assignee: GMN Georg Muller Nurnberg GmbH, Fed. Rep. of Germany

[21] Appl. No.: 865,599

[22] Filed: May 22, 1986

Related U.S. Application Data

[63] Continuation of Ser. No. 667,429, Nov. 1, 1984, abandoned, which is a continuation-in-part of Ser. No. 546,923, Oct. 31, 1983, abandoned, which is a continuation-in-part of Ser. No. 412,869, Aug. 30, 1982, abandoned.

[30] Foreign Application Priority Data

| | | | |
|---|---|---|---|
| Aug. 30, 1982 | [DE] | Fed. Rep. of Germany | 3218656 |
| Aug. 3, 1983 | [DE] | Fed. Rep. of Germany | 3302881 |
| Aug. 3, 1983 | [DE] | Fed. Rep. of Germany | 330881 |
| Nov. 4, 1983 | [DE] | Fed. Rep. of Germany | 3339942 |

[51] Int. Cl.[4] ..... B24B 7/22

[52] U.S. Cl. ..... 51/283 R; 51/125; 51/134; 51/209 R

[58] Field of Search ..... 51/125, 125.5, 134, 51/165 R, 165.77, 209 R, 209 DL, 209 S, 215 AR, 215 HM, 216 LP, 216 ND, 216 H, 237 T, 283 R

[56] References Cited

U.S. PATENT DOCUMENTS

| | | | |
|---|---|---|---|
| 653,531 | 7/1900 | Richmond et al. | 51/283 |
| 2,315,475 | 3/1943 | Cobb et al. | 51/125 |
| 3,142,942 | 8/1964 | Celovsky | 51/216 ND X |
| 3,665,648 | 5/1972 | Yamanaka | 51/134 |
| 3,841,028 | 10/1974 | Katzke | 51/125 |
| 4,064,660 | 12/1977 | Lampert | 51/283 R |

FOREIGN PATENT DOCUMENTS

| | | | |
|---|---|---|---|
| 599830 | 5/1978 | Switzerland | 51/134 |

*Primary Examiner*—Robert P. Olszewski

[57] ABSTRACT

A method for machining a disk-shaped workpiece, for example having a thickness of between 350 and 1200 microns, formed of brittle crystalline material having a Vickers hardness greater than about 7,000 N/mm$^2$ in the manufacture of a wafer having a fine thickness, such as in the range of between about 60 and 250 microns, comprises a "cross" grinding operation including the steps of situating the workpiece in opposed relationship to a flat grinding surface of a rotating cup-type grinding wheel and infeeding or plunging the grinding wheel with respect to the workpiece in a direction substantially parallel to the axis of rotation of the grinding wheel at a controlled rate while maintaining the workpiece fixed and stationary with respect to the axis of rotation of the grinding wheel until a layer of the workpiece having a specifically predetermined optimal thickness has been abraded. The method of the invention provides increased yields of wafers with improved surface quality and precision and with decreased depth of damage of the crystal lattice structure.

11 Claims, 8 Drawing Figures

METHOD FOR MACHINING WORKPIECES OF BRITTLE HARD MATERIAL INTO WAFERS

BACKGROUND OF THE INVENTION

This application is a continuation of application Ser. No. 667,429 filed Nov. 1,1984 which is a continuation-in-part of application Ser. No. 546,923 filed Oct. 31, 1983 which is a continuation-in-part of application Ser. No. 412,869 filed Aug. 30, 1982, now all abandoned.

The present invention relates generally to the machining of workpieces and, more particularly, to the machining of thin wafers of brittle, hard material. Specifically, the invention relates to methods for machining workpieces formed of crystalline materials having Vickers hardnesses greater than about 7,000 N/mm$^2$ into wafers having very fine thicknesses, such as in the range of between about 60 and 250 microns, and wafers produced by the method.

The invention has specific applicability to the machining of so-called semiconductor wafers, i.e., thin wafers formed of semiconductor materials such as silicon, germanium, sapphire, garnet, spinel and compounds including one element from Group IIIA and an element from Group VA of the Periodic Table, used as substrates for electronic components, although the invention is applicable in the machining of wafers of other types of materials for other purposes as described below.

The machining of thin wafers formed of brittle, hard material and the wafers produced by such machining are subject to several diverse requirements. On the one hand, the machining operation should have high capacity to obtain economical yields. On the other hand, the finished product must meet precise physical requirements. In particular, the wafers produced by the machining operation must have a fine thickness, e.g., in the range of between about 60 and 250 microns, with minimum variations in thickness, i.e., a high degree of parallelism between the opposed wafer surfaces which must in turn be extremely flat, i.e., exhibit minimum surface roughness. In the case of semiconductor wafers which are formed of crystalline material, the so-called "depth of damage" of the crystal lattice structure which occurs in the region of the machined surface must be kept at a minimum in order to preserve the desired electrical characteristics of the wafer.

To the present, increases in machining capacity have been achieved only at the expense of machining precision and surface quality. Conventional machining methods and equipment are designed to provide either increased accuracy in surface quality or increased material removal capacity. It has not been possible to achieve all objectives simultaneously in a satisfactory manner using conventional techniques.

Workpieces formed of hard and brittle, crystalline material, such as silicon, are conventionally machined into wafers, such as are used as carriers or substrates for electronic circuits, by so-called "surface" grinding techniques which have replaced earlier, slower lapping operations. In particular, a plurality of workpieces are prepared by sawing disks, for example having a thickness of between about 350–1200 microns, from a previously formed cylindrical piece. The workpieces so prepared are then subjected to surface grinding operations to obtain final thicknesses and required precision surface quality. Both batch-type and continuous surface grinding techniques are conventional.

According to the batch-type surface grinding method, a plurality of workpieces are positioned on a rotary worktable over which a vertical spindle rotating grinding wheel is positioned. While the worktable rotates the rotating grinding wheel is advanced or infed in the direction of its axis of rotation towards the worktable until it reaches a certain position whereupon the peripheral edge of the grinding wheel engages each workpiece a small distance below its upper surface to cut a shallow layer of material therefrom as the workpiece is fed through the grinding zone on the rotating worktable. The grinding wheel is infed a predetermined distance for each rotation of the worktable until the machining is completed.

Another batch-type surface grinding technique which has been used especially in the machining of silicon wafers utilizes a longitudinally reciprocating table on which a plurality of disk-shaped workpieces are disposed. The workpieces are fed past a grinding wheel with each stroke of the worktable whereupon the peripheral edge of the wheel cuts a shallow layer of material from the workpieces. After each worktable stroke, the grinding wheel is infed a predetermined distance until the desired amount of material has been removed from the workpieces.

Although the batch-type surface grinding techniques produce wafers having relatively good surface quality, they have proven to be rather slow and the yields obtained are not as good as desired.

According to the continuous surface grinding methods, individual disk-shaped workpieces fixed to a slowly rotating worktable continuously pass through several grinding stations in a sequential manner, a rotating grinding wheel being situated at each respective station. Each grinding wheel is located at a predetermined fixed height from the worktable with the height of the respective grinding wheels decreasing in the direction of workpiece movement. The grinding wheels are designed and positioned such that a thin layer of material is cut from each workpiece by the peripheral edge of each grinding wheel as the workpieces pass through each station so that the desired amount of material has been removed from each workpiece by the time the workpiece has passed through the last grinding station. Unlike the batch-type surface grinding technique, each workpiece undergoes only a single pass in the continuous surface grinding method.

Although the rate of material removal is relatively high in the continuous surface grinding technique, the quality of the wafers produced is generally considered to be no better than in the case of the batch-type process.

The conventional surface grinding techniques described above have been found to produce finished wafers in which the depth of damage of the crystal lattice structure can be greater than desired. Moreover, traces of the machining operations are often visually evident in the ground surfaces of the finished wafers. These deficiencies significantly increase the possibility of the wafer rupturing during handling and use and, moreover, in the case where the wafers are used as substrates or carriers of electronic circuits, adversely affect the electrical characteristics of the wafers. The damage to the crystal lattice structure in the region of the ground surfaces of the wafers and the visually evident traces of machining also have a significant adverse affects upon subsequent treatment and diffusion operations to which the wafers are subjected. Indeed, the less the depth of damage to the crystal lattice structure, the thinner the workpiece can be ground.

The preparation of wafers using lapping operations is also not entirely satisfactory. Lapping operations have generally been used for polishing wafers already substantially at their desired thickness in order to provide parallel smooth surfaces. The surface of the wafer is pressed and held against a rotating polishing disc and a polishing compound consisting of loose abrasive particles contained in an abrasive liquid is flowed upon the rotating disc. The polishing operation takes place for an indefinite period of time and the surface characteristics measured using guage blocks during periodic interruptions of the operating cycle. The extent of removal of material cannot be predetermined and the need for periodic interruptions slow the operation. Moreover, the loose abrasive grains tend to damage the surface of the workpiece.

Circumferential grinding techniques, i.e., wherein the peripheral surface of a grinding wheel is infed or plunged into contact with the workpiece surface to be ground, are not suitable for machining extremely hard and brittle material, such as silicon, to extremely fine thicknesses. In such methods the grinding zone is confined to a small area or line which results in unavoidable radial deviations and vibrations of the periphery of the grinding wheel. Such deviations in turn lead to large depths of crystal lattice damage and can easily cause the extremely thin, brittle workpieces to fracture.

SUMMARY OF THE INVENTION

Accordingly, it is an object of the present invention to provide a new and improved method for machining wafers of brittle, hard material.

Another object of the present invention is to provide a new and improved method for machining wafers formed of brittle crystalline material having a Vickers hardness greater than about 7,000 N/mm$^2$ to a final thickness in the range of between about 60 and 250 microns.

Still another object of the present invention is to provide a new and improved method for machining wafers of brittle hard material having a machining capacity well in excess of conventional machining methods.

A further object of the present invention is to provide a new and improved method for machining wafers of brittle hard crystalline material wherein the depth of damage to the crystal lattice structure in the vicinity of the machined surface of the wafer is minimized.

A still further object of the present invention is to provide a new and improved method for machining wafers of brittle hard material wherein the grinding precision and surface quality obtained are significantly improved and wherein the number of operational steps generally required in the machining of such materials is reduced.

Yet another object of the present invention is to provide a new and improved wafer formed of hard brittle material which has better surface quality and which is thinner than wafers obtained using conventional techniques.

Briefly, in accordance with the present invention, these and other objects are attained through the utilization of so-called "cross" grinding technique to machine workpieces formed of brittle crystalline materials of Vickers hardnesses in excess of 7,000 N/mm$^2$ into wafers having a fine thickness, such as in the range of between about 60 and 250 microns.

The method of the invention has particular applicability to the machining of semiconductor wafers, i.e., carriers or substrates for integrated electronic circuits, extremely thin wafers formed of mono- or polycrystalline semiconductor materials which are brittle and vulnerable to fracture during machining and which have Vickers hardnesses in the range of between about 7,000 N/mm$^2$ and 35,000 N/mm$^2$. The best known example of such materials is silicon having a Vickers hardness of up to 11,500 N/mm$^2$.

Other examples of materials conventionally used for semiconductor wafers include germanium with a Vickers hardness of up to 7,500 N/mm$^2$, spinel with a Vickers hardness of up to 14,000 N/mm$^2$, sapphire and gallium-gadolinium-garnet (GGG) with Vickers hardnesses of 19,000 to 21,500 N/mm$^2$ and compounds including one element from Group III A and an element from Group V A of the Periodic Table.

In addition, the invention is applicable in the production of wafers from workpieces made of extremely hard sintered powder materials, such as silicon carbide (SiC) with a Vickers hardness of 15,000 to 25,500, silicon nitride ($Si_3N_4$) with a Vickers hardness of 15,000–25,500 (or 35,000 in the case of individual crystals) and boron carbide ($B_4C$) with a Vickers hardness of 22,500 to 31,000. Materials of this type find application in various areas, such as the manufacture of motors and as cutting materials. The invention is also applicable to the machining of ceramics which serve as nonmetallic cutting materials, e.g. corundum ($Al_2O_3$), such materials having a Vickers hardness of between 17,000 to 28,500 N/mm$^2$. As used herein, the term "crystalline" is understood as not being limited to monocrystalline or polycrystalline material, but also includes aggregates of sintered crystals, i.e. materials which are not amorphous.

In contrast to conventional surface grinding techniques now employed for grinding thin wafers of such materials which utilize three separate movements during the grinding operation, namely, rotation of the grinding wheel, infeed movement of the grinding wheel in the direction of its axis of rotation (in the case of batch-type surface grinding and which is analogous to the provision of separate grinding wheels at different respective heights in the case of the continuous surface grinding technique) and feed movement of the workpiece on the worktable past the grinding wheel, cross grinding in accordance with the invention involves only two movements, namely, the rotation of the grinding wheel and the precisely controlled infeed or advancement of the grinding wheel towards the workpiece in the direction of the axis of rotation of the grinding wheel. Unlike surface grinding wherein the workpiece undergoes a critical feed movement past the grinding wheel during the grinding operation, the workpiece remains stationary and fixed with respect to the axis of rotation of the grinding wheel during cross grinding.

The cross grinding operation according to the invention thus involves advancement of a rotating grinding wheel at a controlled rate onto the surface of the workpiece until a layer of the workpiece having a specifically predetermined optimal thickness has been. abraded. The grinding wheel includes a planar grinding or abrasive surface, preferably having an annular shape. A cup-type wheel is thus preferred for use in the method. However, unlike conventional cup wheels used in surface grinding of semiconductor wafers where cutting action occurs at the peripheral edge of the wheel, the grinding action according to the invention occurs at the planar face of the wheel. Moreover, in accordance with the invention, the abrasive surface of the grinding wheel is preferably dimensioned such that the entire surface of the workpiece is covered by it during the grinding operation. For this reason, the annular surface of the cup-type wheel at which the grinding occurs has a significantly greater radial width than cup wheels conventionally used in surface grinding. It will be understood that it is possible in the case where an unusually wide workpiece is being machined to provide repeated so-called partial cross grinding operations whereby the workpiece is displaced (out of engagement with the grinding wheel) after each cross grinding operation relative to the axis of rotation of the grinding disk.

Certain of the aspects involved in cros grinding have been used in so-called disk grinding techniques. In disk grinding, a workpiece, sometimes held in a fixture, is pressed against the planar grinding surface of a rotating disk wheel. Such methods have been used exclusively for non-precision grinding applications where surface quality requirements were minimal and precision was not required. Thus, disk grinding has conventionally been used to finish surfaces and remove stock rapidly where close tolerances are not required. For example, disk grinding has been used in such applications as deburring the ends of cast iron pipes and finishing metallic products, such as automobile hub caps.

It has conventionally been assumed that the principles of disk grinding could not be applied in the machining of workpieces of hard and brittle materials which are subject to fracture to obtain thin wafers having extremely good surface finishes with high precision. However, it has been discovered, completely unexpectedly, that cross grinding in accordance with the invention is an exceptionally effective process for us in the precision manufacture of thin wafers of hard and extremely brittle crystalline materials whose surfaces are vulnerable to crystal lattice destruction while at the same time providing a grinding capacity which is several times greater than in the case of arrangements using conventional surface grinding processes.

Other advantages obtained by the method of the invention will be described in greater detail below.

DETAILED DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE INVENTION

Figure 1:
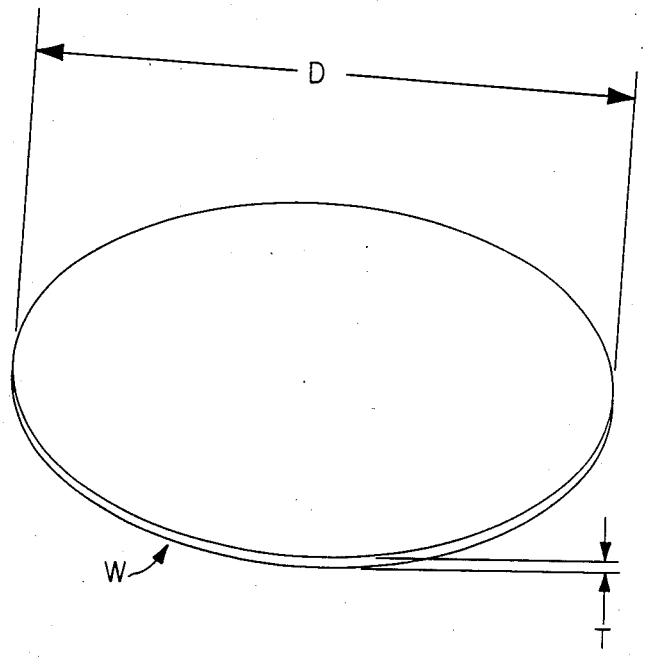
FIG. 1 is a perspective view of one configuration of a wafer of typical dimensions according to the invention machined in accordance with the method of the present invention.

Although the reasons for the significant improvements achieved through the use of cross grinding in accordance with the invention in the manufacture of high precision thin wafers formed of hard, brittle material, such as semiconductor wafers, relative to conventional surface grinding techniques are not entirely understood, an analysis of the respective mechanisms of material removal of conventional surface grinding and cross grinding operations may give an indication thereof.

Conventional surface grinding techniques, as noted above, utilize three separate relative movements between the workpiece and grinding wheel to achieve the desired material removal and surface quality, namely, (1) the rotation of the grinding wheel which provides a cutting action at its outer peripheral edge, (2) the feed movement between the workpiece and the grinding wheel parallel to the plane of the surface to be ground, and (3) the infeed movement wherein the grinding wheel is moved in a direction parallel to its axis of rotation and perpendicular to the workpiece surface to be ground.

Thus, the removal of material takes place substantially entirely at the outer edge of the grinding wheel in conventional surface grinding techniques, so that as the grinding wheel traverses over the workpiece during the feed movement, the zone of material removed in the form of a shallow shoulder formed on the workpiece surface migrates ove the entire surface at the feed rate.

The results achieved by conventional surface grinding techniques are limited by several factors. Since the grinding or cutting action in surface grinding occurs only at the peripheral edge of the grinding wheel, the grinding capacity or material removal rate is limited by the number of abrasive grains at the outer edge of the grinding wheel which is small relative to the total number of abrasive grains present on the grinding wheel surface. Similarly, the space between the abrasive grains which is available to carry away the material cut from the workpiece is likewise quite limited. Furthermore, as the depth of cut of the grinding wheel increases the forces acting normal to the surface being ground also increase. Such forces, in addition to increasing the depth of damage of the crystal lattice structure of the workpiece being machined, thereby limiting the thinness to which it can be ground, also can fracture the workpiece if permitted to become too great.

In accordance with the cros grinding technique of the invention, the cutting action of the abrasive grains is produced only by the rotation of the grinding wheel and the infeed movement wherein the planar abrasive surface of the grinding wheel approaches and engages the surface of the workpiece to be ground in the direction parallel to the axis of rotation of the grinding wheel and perpendicular to the surface to be ground. The feed movement, i.e., the relative movement between the grinding wheel and the workpiece parallel to the plane of the surface to be ground, which is understood in conventional surface grinding techniques as being a dominant operational parameter and one which requires expensive adjustable feed regulating devices in high-quality grinding machines, is completely eliminated.

The cross grinding method according to the invention includes the step of plunging or infeeding the rotating grinding wheel at a certain controlled rate into the surface of the workpiece to be ground which is held rigidly stationary during the grinding operation. The controlled infeed is continued until a layer of the workpiece having a specifically predetermined thickness has been removed. The grinding surface of the grinding wheel is preferably dimensioned so that the entire surface of the workpiece to be ground is covered thereby. However, it is understood that in the case of larger workpieces, a repetitive partial plunging technique of the type described above is also possible wherein only a portion of the workpiece surface is ground in the initial infeeding step whereupon the workpiece is shifted with respect to the axis of the grinding wheel by a distance substantially equal to the width of the abrasive surface of the grinding wheel after each grinding step has been completed and the grinding wheel partially retracted. It is understood that the workpiece itself remains fixed in position during the plunging of the rotating grinding wheel onto the surface to be ground.

The cross grinding method according to the invention has surprisingly resulted in extraordinarily good material removal rates when applied in the machining of thin wafers from hard, brittle material as compared to conventional surface grinding techniques. This significant increase in grinding capacity may be due to the fact that in the cross grinding method of the invention, all of the abrasive grains present on the abrasive surface of the grinding wheel take part in material removal. Moreover, it has been found that under appropriate operating conditions not only is grinding capacity increased but, additionally, the forces acting normal to the surface being ground during cross grinding are significantly less than in the case of surface grinding. This results in improved surface finishes and minimal depth of damage of the crystal lattice structure a lowing thinner wafers to be machined than has been possible heretofore.

Referring now to the drawings, a typical wafer, designated W, machined in accordance with the method of the invention is illustrated in FIG. 1. Wafer W is formed of silicon having a circular outer configuration having a diameter D and a thickness T. Wafer W is useful as a semiconductor wafer, i.e., as a substrate for printed circuits, the wafer being diced subsequent to machining as will be understood by those skilled in the art.

The diameter D generally is in the range of between about 200 mm and 2 inches while the thickness T is generally in the range of between 60 and 250 microns. Other diameters and thicknesses are possible.

It will be understood that the term "wafer" is used herein in its broadest sense and is not limited to a product having a circular configuration but, rather, includes any product having a substantially planar form with thicknesses on the order of those mentioned above.

Figure 2:
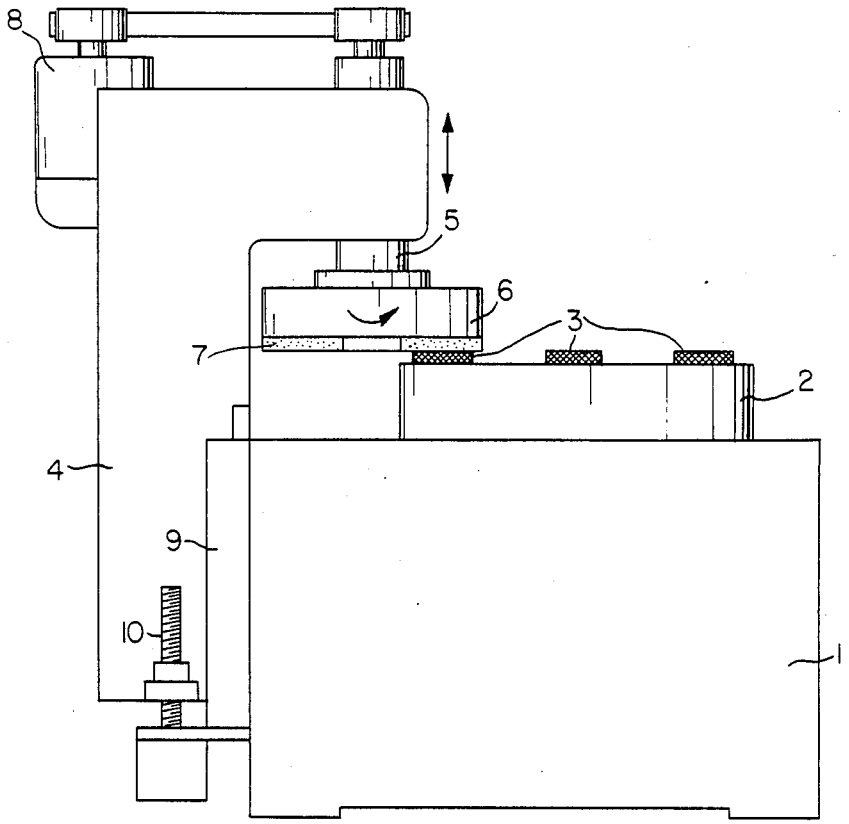
FIG. 2 is a schematic elevation view of one embodiment of apparatus for performing the method of the present invention.

Referring to FIG. 2, apparatus for performing a method in accordance with the invention is illustrated. It is essential that the frame of the apparatus be extremely rigid. A stand or base 1 has an upper horizontal surface. A worktable 2 is mounted on the upper surface of the stand 1 in a manner such that it can be rotatably indexed over 120° sectors and locked in place after each intermittent rotation during the grinding process. The worktable receives and transports the workpieces 3 for grinding and then further transports the finished wafer after grinding to an unloading station as described below. A support 4 has a portion which overlies the worktable 2. A precision controlled grinding spindle 5 is rotatably mounted in support 4 and is coupled to a drive motor 8 mounted on support 4 for rotating the same. The spindle 5 carries the grinding wheel 6 having an annular grinding surface 7 which faces the workpiece 3 when the latter is fixed in its grinding position. The support 4 is coupled to the stand 1 by means of guide elements 9 which guide the support 4 in a vertical direction, the movement of the support 4 being accomplished by means of an electrically driven adjusting spindle 10. Thus, the infeed movement of the grinding wheel in the direction parallel to its axis of rotation is set by the spindle 10.

Accordingly, the infeed or "plunging" movement of the grinding wheel 6 towards the workpieces 3 is accomplished through suitable actuation of the adjusting spindle 10, the grinding wheel 6 being infed at a certain predetermined dimensionally-controlled rate onto the surface of the workpiece 3, which remains stationary, and continuing until a specifically predetermined, optimal layer is abraded whereupon the spindle 10 causes the arm 4 and grinding wheel 6 to be retracted upwardly in a rapid manner. During the upward or retracting motion of the grinding wheel 6, the finished product is removed from the grinding station through the indexing of the worktable 2 until the finished product reaches the unloading station at which point it is removed and a new workpiece to be machined is located at the loading station of the worktable. Of course, the indexing of the worktable is synchronized with the plunging movement of the grinding wheel so that a new workpiece is positioned in a fixed, stationary manner at the grinding station while the grinding wheel is in an upper position thereby assuring that the new workpiece and the grinding wheel do not collide. The workpieces may be fixed in position through the means of a vacuum system located beneath the supporting surface of the worktable.

In operation, a workpiece 3 is fixed in position relative to the axis of rotation of grinding wheel 6 whereupon the latter is infed or plunged in a direction parallel to its axis of rotation into contact with the surface of the stationary workpiece 3. The plunging movement is continued at a certain controlled rate until the desired predetermined amount of material has been removed from the workpiece 3. Thus, the only relative movements between the workpiece and rotating grinding wheel during the grinding process will be those of the rotation of the grinding wheel itself and the infeeding or plunging of the grinding wheel into the surface of the workpiece 3 in a direction parallel to the axis of rotation of the grinding wheel. As noted above, the abrasive surface of the grinding disk preferably completely overlaps the surface of the workpiece being machined.

Figure 3:
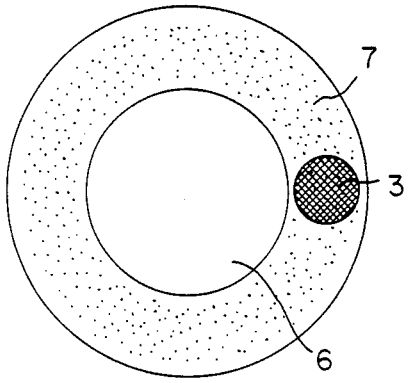
FIG. 3 is a schematic bottom plan view of one embodiment of a cup-type grinding wheel and workpiece illustrating a preferred dimensional relationship therebetween in accordance with the method of the invention.

Referring to FIG. 3, the positional and dimensional relationships between the annular abrasive grinding surface 7 of the grinding wheel 6 and the workpiece 3 are illustrated. The grinding wheel 6 has a grinding surface 7 that faces the workpiece 3, preferably completely overlapping the workpiece surface to be ground. It is understood that whereas the grinding wheel 6 rotates during the grinding operation, the workpiece 3 is firmly fixed and does not undergo any feed movement in accordance with the invention. In this manner, all of the abrasive grains of the grinding surface 7 participate in material removal.

Figure 4C:
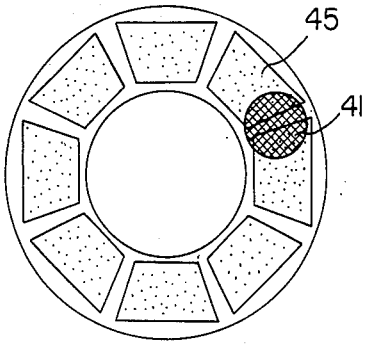
FIGS. 4*a*–4*e* bottom plan views similar to FIG. 3 illustrating respective alternative embodiments of grinding disks used in the practice of the method of the invention.
Figure 4A:
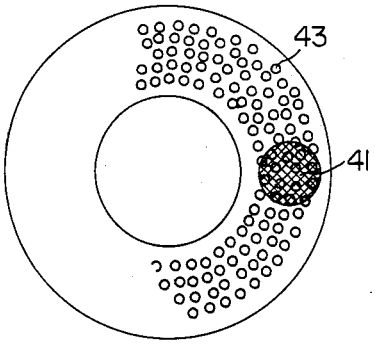
Figure 4D:
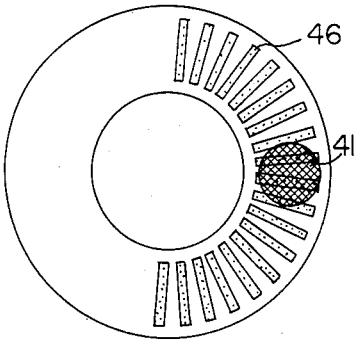
Figure 4B:
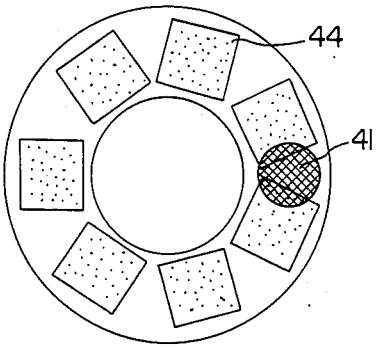
Figure 4E:
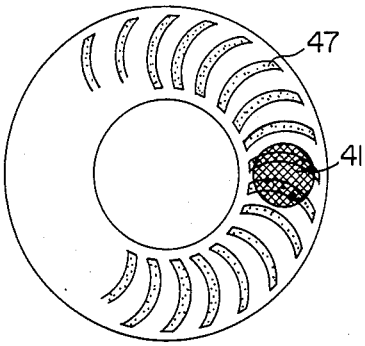

Referring to FIGS. **4*a*–4*e*, various embodiments of grinding surfaces which can be used in accordance with the present invention are illustrated. In each case, the workpiece to be ground is designated 41. The grinding surface 43 of FIG. 4***a* comprises a plurality of grinding body pellets 43. FIGS. 4*b*–4*c* illustrate grinding surfaces comprising a plurality of grinding elements fixed to the grinding wheel. The grinding elements 44 and 45 illustrated in FIGS. 4*b* and 4*c* respectively have parallelepipedal and trapezoidal configurations. The grinding elements 46 and 47 illustrated in FIGS. 4*d* and 4*e* have rod-shaped and arcuate configurations respectively.

In all of the illustrated embodiments, the grinding surfaces completely overlap the area of the workpieces 41. Moreover, in the case of FIGS. 4*b*–*4e* the spaces between the grinding elements are less than the diameter of the workpiece 41. All of the abrasive grains will therefore take part in material removal during the grinding operation which contrasts with conventional surface grinding techniques in which only the abrasive grains located at the peripheral edge of the grinding wheel participate in material removal.

Although the grinding wheel used in the practice of the invention preferably comprises a cup-type wheel as described above, other types may be appropriate such as disk or crow wheels. The wheel chosen must present a rotating planar grounding surface which, preferably, covers the entire workpiece surface to be ground.

An advantage obtained by the above-described arrangement is that the grinding load as well as the area of engagement of the grinding wheel on the workpiece remain constant during the entire grinding operation. This results in an extremely uniform grinding pattern and a stable grinding operation.

The machining capacity or rate of material removal achieved in accordance with the invention is significantly greater than that obtained using conventional surface grinding techniques. Although such high capacities could be approached using conventional grinding operations, relatively coarse-grained grinding disks were required. However, the method of the present invention permits the use of relatively fine-grained grinding wheels while achieving high machining capacities and the use of fine-grain grinding wheels enables the surface of the workpiece to be ground to a smoother finish with less change or damage to the crystal lattice structure in the region of the workpiece surface which comes into contact with the grinding wheel.

The smoothness and surface finish of the workpieces can be even further improved by a modification of the cross grinding method. In particular, after terminating the infeed movement of the grinding wheel and prior to retracting it, the workpiece may be moved in a direction parallel to the surface of the grinding wheel while the grinding wheel continues to rotate until the workpiece is out of engagement therewith. Such step is similar to a so-called "sparking-out" process. In this manner, physical traces formed in the workpiece surface caused by minute irregularities in the projection of the abrasive grains from the grinding surface can be equalized.

The rate of infeed of the grinding wheel is preferably in the range of between about 0.1 to 50 mm per minute with a grinding wheel having an outside diameter which generally does not exceed a diameter of about 410 mm for workpieces having a diameter of about 150 mm. In one embodiment the diamond abrasive section has a coarseness of D*46* as defined in DIN 848 with the grains being resin bonded to the wheel, the ring-shaped diamond abrasive section having a width of 110 mm and a height of 2 mm.

Using the method of the present invention, wafers are obtained whose surfaces deviate from precise parallelism by less than about 3 microns, a thickness spread of plus or minus 3 microns, a surface finish of between about Ra=0.06−0.6 microns and a depth of damage to the crystal lattice structure of between about 4 and 11 microns. Material removal capacity of workpieces having a diameter of 100 mm is in the range of between about 100 to 1,000 microns per minute.

Further with respect to the grinding wheel used in the practice of the method of the invention, in order to maintain the high precision surface qualities of the wafer, it is only necessary to maintain the abrading surface of the grinding disk level. This is to be contrasted with the requirements imposed on the grinding wheels used in conventional surface grinding techniques which are moved with a very slow feed and shallow cutting depth over the surface of the workpiece. These grinding wheels require a fine-grained grinding surface with an elliptically graduated rounding of the peripheral cutting edge thereof in order to obtain the required surface quality. Even where the grinding wheels used in conventional surface grinding are originally provided with such features, the optimal surface qualities of the finished wafer cannot easily be maintained and ar not reliably reproducible.

Thus, the grinding wheels used in the practice of the method of the invention are relatively simple in construction and manufacture. Generally, the abrasive grains, preferably diamond, are bonded to the wheel in annular or continuous ring-shaped form (FIG. 3) or in segmental or sectored form (FIG. 4). In the case where a sectored grinding wheel is used, the free spaces between the individual grinding sectors enhance the cooling effect and facilitate the removal of the material ground from the workpiece. The distance between the individual grinding elements or segments should be smaller than the surface of the workpiece being machined in order to avoid the possibility that a workpiece can slip between a pair of adjacent segments resulting in a type of conventional surface grinding. The abrasive grains are preferably held by a resin bond, such as a synthetic organic or plastic compound. As noted above, the use of the plunge grinding technique enables the use of finer abrasive grain sizes which in turn results in finer surface finishes for the wafers of non-metallic material being ground.

Comparative tests have been performed which illustrate the unexpected advantages obtained by the method of the invention relative to the batch-type and continuous surface grinding techniques conventionally used in the machining of thin wafers of hard, brittle crystalline material.

In each of the tests the workpieces were circular blanks of silicon having a diameter of 100 mm from which a thickness of 250 microns was ground.

Test A was of a batch-type surface grinding operation wherein a MPS-R600 grinder available from GMN Georg Muller Nurnberg GmbH of Nurnberg, West Germany was used. Eighteen circular blanks were loaded at one time on the rotary worktable. The grinding wheel was a resin bonded diamond cup wheel having a diameter of 300 mm. The width of the diamond section was 5 mm, its height 4 mm and its coarseness D46. The infeed rate of the grinding wheel was 3.5 microns for every revolution of the work table.

Test B was of a continuous surface grinding operation wherein a series 650 grinder available from Disco Abrasive Systems Ltd. was used. The grinder includes three grinding stations at which vertically fixed grinders were positioned and the rotary table on which the workpieces were clamped, rotated at a speed of 0.08 rpm. Each grinding wheel was a galvanic nickel bonded diamond cup wheel having a diameter of 200 mm. The width of the diamond section was 4 mm with about 50% of the diamond section serving as the cutting area and the coarseness of the diamond sections for the three grinding wheels were D46, D15 and D7 respectively.

Test C was of a cross grinding operation in accordance with the invention wherein an MPS-T500 grinder available from GMN Georg Muller Nurnberg GmbH of Nurnberg, West Germany was used. The grinding wheel was a resin bonded diamond cup wheel having a diameter of 345 mm. The width of the diamond section was 100 mm, its height was 2 mm and its coarseness D46. The rate of infeed of the grinding wheel was 1000 microns per minute.

The results of the comparative tests are illustrated in the table below:

| | Yield (wafers/hour) | Force on Workpiece (Newtons) | Depth of Damage of Crystal Lattice (Microns) | Abrasion Ratio | Surface Roughness Ra (Microns) |
|---|---|---|---|---|---|
| Test A (Batch-type Surface Grinding) | 72 | 1000 | 10 | 17,750 | 1.5 |
| Test B (Continuous Surface Grinding) | 56 | 1375 | 12 | 17,920 | 1.4 |
| Test C (Cross or Plunge Grinding) | 140 | 500 | 7.5 | 25,220 | 1.3 |

It is seen from the above table that the yield achieved by the method of the invention is somewhat less than about three times that achieved with the continuous surface grinding technique and about twice that achieved with the batch-type surface grinding technique. The grinding forces which were measured directly at the support fixtures of the workpieces by means of piezoceramic pressure recorders in tests A and C and which were obtained from test reports in the case of test B, indicate the overall force acting normal to the grinding wheel surface. It is seen from the results that contrary to usual thinking, the cross grinding operation according to the invention results in the reduction of the force in the grinding zone of the grinding wheel/workpiece surface to less than half of the values obtained in the respective surface grinding techniques. This in turn results in the important advantages of less stress being imparted on the tool and workpieces with consequent reduced wear and tear on the grinder, reduced destruction of the crystal lattice structure of the wafer produced and greater precision with respect to wafer thickness and parallelity. The depth of damage of the crystal lattice was significantly less in the case of test C and surface roughness was also reduced.

The abrasion ratio is defined as the ratio of the volume of workpiece material removed to the volume of worn abrasive material of the grinding wheel. Thus, a larger abrasion ratio indicates a longer service life of the grinding wheel. It is seen from the above table that the abrasion ratio achieved by the cross grinding technique of the invention is significantly greater than those achieved with the surface grinding techniques. The increase of the abrasion ratio achieved by the plunge grinding operation occurs due to the fact that the grinding forces are about 40–50% lower than in the surface grinding operations. The grinding force is effected on the individual abrasive grains and does not alter its spatial direction during plunge grinding. However, this is not the case with the surface grinding techniques since the wafers change their orientation with respect to the grinding wheel due to the feed movement of the workpieces.

The surprising advantages obtained by the cross grinding technique in the machining of wafers of hard, brittle crystalline material moreover permit even large wafers, e.g. up to a diameter of about 160 mm, to be ground to a thickness of about 80 microns. This is not possible using either of the surface grinding techniques unless considerable increases in grinding time are acceptable and even in this case wafer breakage becomes unacceptably high with yields being decreased by a factor of about 70%.

The various advantages obtained through the use of the method of the present invention will now be discussed in somewhat greater detail.

The cross grinding technique results in the important advantage of significantly higher machining capacity with relatively low stresses being imparted to the workpiece and grinder. This makes it possible to grind brittle materials to extremely fine thickness ranging between 60 and 250 microns, preferably between 80 and 120 microns, since the depth of damage of the crystal lattice structure of th workpiece is significantly reduced. Brittle monocrystalline silicon which is extremely vulnerable to fracture can thus be ground to a final thickness of about 80 microns which is to be contrasted with minimum thickness of 160 microns achieved by conventional surface grinding methods.

The improved surface finish obtained by the method of the invention also results in significant improvements in the grinding of the reverse or back side of the wafers. In order to fully appreciate this important advantage, the sequence of operations in the manufacture of a semiconductor wafer should be understood. In such manufacture, a disk-shaped workpiece of, e.g., silicon having a thickness of, e.g., 400 microns, is sawed or cut from a cylindrical piece of stock. At this time each surface of the workpiece is ground in accordance with the method of the invention so that each surface of the workpiece is provided with a suitable finish, i.e., high smoothness and minimum depth of damage of the crystal lattice structure, to permit subsequent physical and chemical operations to be applied to either side in the application of the integrated circuitry thereon. The reason for finishing both sides of the workpiece at this stage is to eliminate the possibility of a technician inadvertently working on an unfinished side of the workpiece.

After the subsequent physical and chemical operations are completed on the so-called front side of the workpiece, the workpiece is positioned on the worktable with the front side bearing on the worktable whereupon the back side grinding is accomplished in accordance with the invention until a final thickness in the range of between about 60 to 250 microns is obtained. It is not necessary to place an intermediate bearing surface between the worktable and the workpiece front surface as in conventional techniques since the forces to which the workpiece is subjected are considerably less than in the case of conventional surface grinding techniques. The front bearing surface of the partially finished workpiece is less subject to being damaged by impressions and machining traces.

Since there is no feed motion which takes place during the cross grinding method of the invention, it is possible to utilize a simpler, more rigid and more stable construction for the grinding machine. Conventional single and multiple station surfac grinding machines operate with circular attachments which function as workpiece receivers and feed devices and with which outwardly increasing feed movements occur. This disadvantage which has an adverse effect upon the material stress and surface quality during grinding is eliminated since the final sparking out movement of the workpiece can optionally be performed, if desired, as a straight-line movement to achieve a precise and even surface.

Conventional surface grinding machines having multiple stations have a single rate of feed regardless of whether grinding is preliminary, fine or extremely fine. However, in the case of the cross grinding method of the invention in which a feed movement is eliminated, the sparking out movement of the workpiece can be individually adjusted so as to be optimal in each case. Generally, such a linear sparking out movement of the workpiece would be required only at the final grinding station. Since the workpiece receiver which holds the workpiece on the worktable is stationary during grinding, a very precise and uncomplicated loading and unloading arrangement is possible.

A further advantage is that the workpiece supporting worktable is firmly and fixedly held upon the machine stand during the grinding operation and thus is very stable.

Another advantage provided by the method of the invention is that a large spatial separation can be provided between the grinding, loading and unloading zones on the worktable. This feature becomes significant in the case of high precision workpieces since the area at which the workpiece is clamped can be maintained in a clean condition until the next workpiece is positioned thereon. This eliminates the possibility of dust particles becoming situated between the workpiece and the worktable which can result in local fissures being formed in very thin substrate wafers.

Yet another advantage of the invention is the low tool costs required. This results from the extended service life of the grinding wheel discussed above which apparently is the result of the use of the maximum number of abrasive grains in the cutting action thereby reducing grain stress and facilitating the removal of material. In other words, the cutting force operating on each individual abrasive grain is constant and stable with respect to the grinding surface. Due to the elimination of the feed motion of the workpiece in the plunge grinding operation, breakout of the abrasive grains from their bond to the grinding wheel is delayed.

Obviously, numerous modifications and variations of the present invention are possible in the light of the above teachings. It is therefore to be understood that within the scope of the claims appended hereto, the invention may be practice otherwise than as specifically disclosed herein.

What is claimed is:

1. A method for machining a workpiece having an as-cut finish formed of a brittle crystalline semiconductor material having a Vickers hardness greater than about 7,000 $N/mm^2$ in the manufacture of a semiconductor wafer having a fine thickness with a finished surface in a single operation, comprising the steps of:

situating the workpiece with a first workpiece surface in opposed relationship to a flat grinding surface of a rotating grinding wheel, the grinding surface being situated in a plane substantially perpendicular to the axis of rotation of the grinding wheel; and infeeding the grinding wheel with respect to the workpiece in a direction substantially parallel to the axis of rotation of the grinding wheel until the grinding surface contacts the first workpiece surface and continuing the infeeding at a certain controlled rate while maintaining the workpiece fixed and stationary with respect to the axis of rotation of the grinding wheel until a layer of the workpiece having a specifically predetermined thickness has been removed.

2. The method of claim 1 including the further subsequent steps of:

resituating sthe workpiece with a second workpiece surface in opposed relationship to a flat grinding surface of a rotating grinding wheel, the grinding surface being siruated in a plane substantially perpendicular to the axis of rotation of the grinding wheel;

infeeding the grinding wheel with respect to the workpiece in a direction substantially parallel to the axis of rotation of the grinding wheel until the grinding surface contacts the second workpiece surface and continuing the infeeding at a certain controlled rate while maintaining the workpiece fixed and stationary with respect to the axis of rotation of the grinding wheel until a layer of the workpiece having a specifically predetermined thickness has been removed.

3. The method of claim 2, wherein a wafer so manufactured has a thickness in the range of between about 60 and 250 microns.

4. The method of claim 2, wherein a wafer so manufactured has a thickness in the range of between about 80 and 120 microns.

5. The method of claim 1, wherein the flat grinding surface of the grinding wheel overlaps the entire workpiece surface during the grinding operation.

6. The method of claim 1 wherein the material of which the workpiece is formed is silicon.

7. The method of claim 1, wherein the material of which the workpiece is formed is a compound formed of one element from Group III A and an element from Group V A of the Periodic Table.

8. The method of claim 1, wherein the material of which the workpiece is formed is selected from the group consisting of germanium, spinel, sapphire and gallium-gadolinium-garnet (GGG).

9. The method of claim 1, wherein the material of which the workpiece is formed is selected from the group consisting of silicon carbide, silicon nitride, boron carbide and sintered ceramic.

10. The method of claim 1, wherein after the desired amount of workpiece material has been removed and with the rotation of the grinding wheel continuing, moving the workpiece in the direction substantially perpendicular to the axis of rotation of the grinding wheel.

11. The method of claim 1, wherein after the grinding surface contacts the workpiece surface, infeeding the grinding wheel at a rate in the range of between about 0.1 to 50 mm per minute.

* * * * *